US005395545A

United States Patent [19]

Fischer et al.

[11] Patent Number: 5,395,545

[45] Date of Patent: Mar. 7, 1995

[54] CLEANING SOLUTION FOR AUTOMATED ANALYZERS

[75] Inventors: Timothy T. Fischer, Raleigh, N.C.; Maria L. Bell, Melbourne, Fla.; Regina J. Bowling, Creedmore, N.C.

[73] Assignee: Akzo N.V., Arnhem, Netherlands

[21] Appl. No.: 141,441

[22] Filed: Oct. 21, 1993

[51] Int. Cl.[6] ..... C11D 10/00; C11D 10/02

[52] U.S. Cl. ..... 252/89.1; 252/173; 252/174.16; 252/174.25; 252/555

[58] Field of Search ..... 252/89.1, 173, 174.16, 252/174.25, 555

[56] References Cited

U.S. PATENT DOCUMENTS 4,115,313 9/1978 Lyon et al. ..... 252/309

*Primary Examiner*—José G. Dees
*Assistant Examiner*—Barbara S. Frazier
*Attorney, Agent, or Firm*—William M. Blackstone

[57] ABSTRACT

This invention relates to a novel cleaning solution for use particularly with automated analyzers used in clinical laboratories and a method of cleaning a surface with the novel cleaning solution. This solution eliminates problems of cross contamination of samples due to reagent carryover, brought about by the analyzer's probe that dispenses more than one reagent. In particular, this solution resolves carryover problems in coagulation assays performed with automated systems.

12 Claims, No Drawings

CLEANING SOLUTION FOR AUTOMATED ANALYZERS

DESCRIPTION OF THE INVENTION

This invention relates to a novel cleaning solution for use particularly with automated analyzers used in clinical laboratories and a method of cleaning a surface with the novel cleaning solution. This solution removes problems of cross contamination of samples due to reagent carryover, brought about by the analyzer's probe that dispenses more than one reagent. In particular, this solution resolves carryover problems in coagulation assays performed with automated systems.

BACKGROUND OF THE INVENTION

Thrombin, thromboplastin and phospholipids are all common ingredients in reagents used for coagulation assays performed on samples of serum and plasma. Thrombin and thromboplastin in particular, are very sticky substances and are difficult to remove from a surface. Because of this property, it is difficult to avoid cross contamination of a second sample by the reagent used in one test that is still adhering to the probe that is then used to deliver a different reagent to a second sample. Cross contamination of a reagent for one assay into a reagent for another assay or into a sample will adversely affect assay results.

This was not a problem when all coagulation assays were done manually, as separate pipettes were used with each reagent and with each sample. A pipette was discarded after each use, thereby eliminating cross contamination problems.

Today, many coagulation assays are performed on analyzers. In most analyzers that have limited random access capabilities, cross contamination problems are avoided by having dedicated fluidic pathways for each reagent. By doing so, the same reagent is constantly dispensed by the same probe or pipette, generally in the same order for a large batch of serum or plasma samples having the same test run. Therefore, the probe or pipette does not have to be cleaned, or cleaned well, between each dispensation of reagent, as the probe or pipette will always be dispensing the same reagent.

However, the next generation of automated coagulation analyzers contains random access capabilities. This means that a limited number of probes attached to fluidic pathways will be dispensing a different reagent into each separate sample container, if the analyzer is so programmed. Automated analyzers that have random access capabilities are therefore subject to cross contamination problems. For example, the presence of thrombin from a fibrinogen assay and thromboplastin from a prothrombin assay on a probe results in a shortening of a samples clotting time in the activated partial thromboplastin time assay. Thrombin, thromboplastin and fibrinogen are particularly difficult to remove from a surface because of their strong adhesion properties. Changes in assay results would affect the diagnosis afforded a patient, thereby causing severe ramifications to the patient's treatment.

Currently, there are some types of cleaners available that remove carryover. These are strong denaturing cleaners, such as sodium dodecylsuifate, 10% bleach solutions or hydrogen peroxide solutions. Although they do remove carryover, these cleaners also denature the reagents at the same time, resulting in poor assay performance results. This occurs because the denaturing cleaners also remain on the probe and are carried back to the reagent vials or are mixed with the reagent as it enters the bore of the probe, prior to the dispensation of the reagent. Therefore, not only must each reagent be thoroughly cleaned from the probe, it must be rapidly cleaned in order for the probe to be able to dispense reagent into a large number of samples in a very short amount of time, for example, 180 samples per hour.

A fully automated coagulation analyzer with random access capabilities to perform analyses related to hemostasis and thrombosis on serum and plasma samples uses common pathways for reagents, thereby necessitating a substantially non-denaturing cleaning solution for the common reagent pathway, the probe.

Therefore, it is highly desirable in the art to have a solution for cleaning a reagent probe from residual coagulation assay reagents, in particular, thrombin, thromboplastin and fibrin, in order to avoid any contamination from the carryover of a reagent from one sample tube to another.

SUMMARY OF THE INVENTION

This invention is a cleaning solution particularly suited to rapidly removing substantially all thromboplastin, thrombin, and phospholipids from a surface. One surface that this solution cleans exceptionally well is that of a probe used in automated analyzers, in particular those that perform coagulation assays. The probe is cleaned of substantially all of thromboplastin, thrombin, and fibrin that may have been present in the first sample or reagent carried by the probe, so much so that no detectable carryover is seen to the next sample that the probe interacts with.

This cleaning solution is an aqueous solution containing a bile salt, an organic acid, an inorganic salt and an anionic surfactant.

The invention also embodies a method for cleaning a surface, making it substantially free of thromboplastin, thrombin, and phospholipids by washing the surface with an aqueous cleaning solution containing a bile salt, an organic acid, an inorganic salt and an anionic surfactant.

DESCRIPTION OF PREFERRED EMBODIMENTS

We have invented a novel cleaning solution that removes strongly adhering substances, such as thrombin, thromboplastin, and phospholipids from surfaces, without leaving a detectable residue on the surface. In particular, this cleaning solution works exceptionally well on surfaces such as reagent probes used in automated coagulation analyzers. This solution works rapidly and is easily rinsed from the surface, leaving no detectable carryover of reagent or solution in the next reagent or sample dispensed from the same probe. This is particularly important in automated systems, as the number of samples tested per hour can be as much as 180.

The cleaning solution is an aqueous solution of a bile salt compatible with anionic surfactants, anionic surfactant, organic acid, and sodium ions. This combination of components results in a highly effective cleaning solution primarily for use in coagulation-based assays, to remove substantially all thrombin, phospholipid and thromboplastin reagents.

Bile salts compatible with anionic surfactants such as taurocholic acid and taurodeoxycholic acid are the first component of the solution. These salts have been used to solubilize and/or stabilize membrane proteins of cells, depending on concentration. The bile salt must be used in a concentration where the final solution remains clear, that is, without a precipitate. It has been found that the range of bile salt useable is from approximately 0.1% w/v to about 2.0% w/v of the final solution. At less than 0.1% and more than 2.0% w/v, it has been found that taurocholic acid precipitates out of solution. The preferred range of bile salt in the final solution is from about 0.5% to about 1.0%. The most preferred concentration is 0.5% of the final solution. These concentrations have been found to effectively remove thromboplastin, thrombin, and phospholipids from reagent probes when used in the final cleaning solution formulation.

It has been found that anionic ethoxylated phosphorylated surfactants produce the best response in this cleaning solution. Other types of anionics are usable, such as sodium dioctyl sulfosuccinate. The bile salt used must be soluble in the surfactant, and the surfactant must remain stable in solution and not be carried over on the probe. Sulfonated surfactants were found to destabilize and affect final test analysis results. Cationic and nonionic surfactants were also found to be ineffective in the final solution formulation.

Anionic surfactants are surface active agents with a negative charge. These are sold by a number of companies under many well known brand names. For example, Karawet TM SB, a blend of phosphorylated ethyoxylates, is sold by Rhone-Poulenc Surfactants and Specialties, Dalton, Ga., USA. Another anionic surfactant applicable in this formulation includes a sodium dioctyl sulfosuccinate, Texwet TM 1001, manufactured by Intex Products Inc., Greenville, S.C., USA. A preferred anionic ethoxylated phosphorylated surfactant is Chemfac TM PC-099, sold by Chemax, Inc., Greenville, S.C., USA. The range of surfactant in the final formulation ranges from about 0.2% to about 2.0% w/v. The preferred amount is about 1.5% w/v.

The next ingredient in the cleaning solution formulation is an organic acid. In particular these are carboxylic acids, such as formic acid and acetic acid. It is believed that these acids aid in the decoupling of proteinaceous material from phospholipid bed. The preferred range of organic acid is about 0.2% to about 5.0% w/v, with the most preferred amount being about 1.0% w/v.

Sodium ions are also integral to the formulation. One way of introducing them into the formulation is through the use of sodium chloride, sodium sulfate or sodium formate. Although other ions appear to be useable to some degree, such as calcium, the sodium ions are part of the optimum formulation. The preferred range of sodium chloride is about 0.5% to about 5.0% w/v, with the most preferred amount being about 3.0% w/v.

The most preferred formulation of the cleaning solution is an aqueous solution of formic acid, 1.0%; taurocholic acid, 0.5%; sodium chloride, 3.0%; and Chemfac TM PC-099, 1.5%. All percentages are in weight-/volume. This formulation removes thrombin, thromboplastin, and phospholipids from probes used in automated coagulation analyzers in a rapid and thorough manner.

A less preferred formulation is formic acid, 0.5% w/v; taurocholic acid, 0.5% w/v; sodium chloride, 3.0% w/v; and Chemfac TM PC-099, 0.75% w/v.

The preferred solution can be prepared in the following manner.

Using an appropriately sized container, add 0.8 liter of purified water and begin mixing. Next, add in a range from approximately 0.2% w/v to about 5.0% w/v of the organic acid, preferably 1.0% w/v of formic acid, to the mixing water and continue mixing until dissolved, approximately 10 minutes. Slowly add the sodium ions in a range from about 0.5% w/v to about 3.0% w/v, most preferably 3.0% w/v of sodium chloride and mix for approximately 10 minutes or until dissolved. Slowly add to this solution the bile salts, in a range from approximately 0.1% w/v to about 2.0% w/v, most preferably 0.5% w/v of taurocholic acid and mix for approximately 15 minutes or until dissolved. Add an anionic surfactant to the solution in a range from approximately 0.2% w/v to about 2.0% w/v. A preferred surfactant is Chemfac TM PC-099 at approximately 1.5% w/v. Mix for about 10 minutes. Using purified water, q.s. to 1 liter and mix for approximately 10 minutes. At ambient temperature, check the pH of the solution and bring it to pH 1.7±0.3. At this point a dye may be added. The final solution should be filtered to produce a clear liquid.

The following examples are provided to describe but not limit the invention.

Example 1. Preparation of the Preferred Washing Solution

This example describes the production of 300 liters of the wash solution.

240 liters of purified water were added to a 300 liter glass container and stirred. Three liters of formic acid were slowly added to the water and mixed at approximately 300 rpm until dissolved. To the solution being stirred was added 9 kg of sodium chloride. Mixing continued at approximately 380 rpm until the sodium chloride dissolved. 1.5 kg of taurocholic acid was added and stirring continued until it dissolved. 4.5 kg Chemfac TM PC-099 was added to the container and mixing continued for approximately 10 minutes. Water was added to bring the volume to 300 liters and mixing continued for another 10 minutes. The pH was kept near 1.7. 3.0 grams of a dye, Violamine R, was added the container, while mixing continued at approximately 200 rpm for about 30 minutes. The solution was then filtered through a 0.2 micron filter prior to use.

Example 2. Reagent Carryover Studies

Experiments were performed to determine the amount of carryover that occurs when a particular reagent, thromboplastin, is used. This carryover occurs when the assay order, in an automated analyzer, the MDA TM (Organon Teknika Corp., Durham, N.C., USA), testing for hemostasis and coagulation values, is to first assay a sample for Prothrombin Time (PT) followed by an assay on a sample for an Activated Partial Thromboplastin Time (APTT). If carryover does occur, clotting occurs more quickly in the APTT assays as the thromboplastin carried over from the PT assay reacts with the proteins in the sample.

An experimental automated analyzer was used to perform these assays. This analyzer has random access capabilities and the order of assays to be run can be programmed. Because of this capability, each probe on the analyzer can deliver or aspirate any number of samples or reagents into various test wells.

The assays were run in the following order on the automated analyzer:

| | |
|---|---|
| PT | MDA Verify 1 (4 replicates) |
| APTT | MDA Verify 1 (4 replicates) |
| PT | MDA Verify 2 (4 replicates) |
| APTT | MDA Verify 2 (4 replicates) |
| PT | MDA Verify 3 (4 replicates) |
| APTT | MDA Verify 3 (4 replicates) |

The reagents used.were MDA TM Simplastin L, a liquid thromboplastin; MDA TM Platelin LS; MDA TM Platelin L $CaCl_2$; water used as the Probe Cleaner; MDA Verify TM 1; MDA Verify TM 2; and MDA Verify TM 3. The MDA and Verify trademarks are that of Organon Teknika Corporation, Durham, N.C., USA. MDA Verify 1, 2 and 3 are plasma controls readily available from Organon Teknika Corporation.

For the PT assay, an aliquot of MDA Verify 1 was aspirated from its container by the first probe, Arm 1, and dispensed into a cuvette well. Each cuvette contained four wells. This was repeated three more times, in order to perform 4 replicates of the assay. After each sampling, Arm 1 was rinsed with a priming solution. The cuvette was then moved down a track to the next station, near Arm 4. Arm 4 aspirated an aliquot of MDA Simplastin L and dispensed it to the first cuvette well, after which Arm 4 was rinsed with water. This was repeated for each well of the cuvette. The cuvette was allowed to react for a short period of time and was then moved by the track to the optics module, where each reaction, a clot formation, was detected. The results of the detection were reported automatically.

As the PT assay was being run, the APTT assays began. An aliquot of MDA Verify 1 was aspirated from its container by the first probe, Arm 3, and dispensed into a cuvette well. Arm 1 was then rinsed with a priming solution. This procedure was repeated three more times to supply a total of four replicates of Verify 1 as sample tested. The cuvette was moved down a track to the next station, near Arm 3, which then aspirated an aliquot of MDA Platelin LS from the its container and dispensed it into the first cuvette well, adding it to the sample. Arm 3 was then washed with water. This step was repeated for each of the remaining three samples. The cuvette was then moved to the next station, near Arm 4, which aspirated an aliquot of MDA Platelin L from its container and dispensed it into the first cuvette well. Arm 4 was then rinsed with water. This step was repeated with each of the remaining three samples. The reaction was allowed to proceed and the cuvette was moved along the track to the optics module where the reaction was detected in each well. The results were reported automatically.

This procedure was repeated with MDA Verify 2 and 3 being run in quadruplicate, with the PT assay being performed first, followed by the APTT assay. The results were obtained by calculating the % Difference from the mean of replicates 2–4 and replicate 1 on APTT assay using the formula:

$$\% \text{ Diff} = 100 \times \frac{(\text{Mean of Replicates 2–4}) - (\text{Replicate 1})}{(\text{Mean of Replicates 2–4})}$$

A high % Difference indicates carryover of thromboplastin,

The results of the assays are given in Table 1 below, The clot times are given in seconds, Std is one standard deviation limit, and % CV is coefficient of variation, An acceptable range of results for these types of assays is within 2 standard deviations,

TABLE 1

| ASSAYS | SAMPLE ID | REPLICATE | CLOT TIME (sec.) |
|---|---|---|---|
| PT | MDA Verify 1 | 1 | 11.35 |
| | | 2 | 11.31 |
| | | 3 | 11.22 |
| | | 4 | 11.40 |
| | | Mean | 11.32 |
| | | Std | 0.07 |
| | | % CV | 0.58 |
| APTT | MDA Verify 1 | 1 | 30.87 |
| | | 2 | 33.53 |
| | | 3 | 33.52 |
| | | 4 | 33.33 |
| | | Mean | 32.81 |
| | | Std | 1.12 |
| | | % CV | 3.43 |
| | | % Diff | 7.74 |
| PT | MDA Verify 2 | 1 | 15.2 |
| | | 2 | 15.2 |
| | | 3 | 15.29 |
| | | 4 | 15.29 |
| | | Mean | 15.25 |
| | | Std | 0.04 |
| | | % CV | 0.30 |
| APTT | MDA Verify 2 | 1 | 46.19 |
| | | 2 | 56.79 |
| | | 3 | 57.59 |
| | | 4 | 57.38 |
| | | Mean | 54.49 |
| | | Std | 4.80 |
| | | % CV | 8.81 |
| | | % Diff | 19.32 |
| PT | MDA Verify 3 | 1 | 21.51 |
| | | 2 | 21.42 |
| | | 3 | 21.54 |
| | | 4 | 21.34 |
| | | Mean | 21.45 |
| | | Std | 0.08 |
| | | % CV | 0.37 |
| APTT | MDA Verify 3 | 1 | 58.63 |
| | | 2 | 73.85 |
| | | 3 | 77.61 |
| | | 4 | 78.32 |
| | | Mean | 72.10 |
| | | Std | 7.96 |
| | | % CV | 11.04 |
| | | % Diff | 23.45 |

As can be seen from Table 1, the use of water as a probe cleaner resulted in faster, inaccurate clotting times in the APTT assays, a result of the carryover of the thromboplastin used in the PT assays affecting the APTT assays. The standard deviations of the PT assay results versus the APTT assay results are much lower and more acceptable. In particular, the first sample of each APTT series reports substantially different results than do the remaining APTT assay results.

Example 3. Use of the Preferred Wash Solution

The wash solution as prepared in Example 1 was used in these experiments as the MDA Probe Cleaner instead of the water used in Example 2. All other reagents remained the same, and the procedure as described in Example 2 also remained the same.

The results of the PT and APTT assays are given in Table 2 below.

TABLE 2

| ASSAYS | SAMPLE ID | REPLICATE | CLOT TIME (sec.) |
|---|---|---|---|
| PT | MDA Verify 1 | 1 | 12.04 |
| | | 2 | 12.14 |
| | | 3 | 12.07 |
| | | 4 | 12.08 |
| | | Mean | 12.08 |

TABLE 2-continued

| ASSAYS | SAMPLE ID | REPLICATE | CLOT TIME (sec.) |
|---|---|---|---|
| | | Std | 0.04 |
| | | % CV | −0.30 |
| APTT | MDA Verify 1 | 1 | 33.23 |
| | | 2 | 33.08 |
| | | 3 | 33.17 |
| | | 4 | 33.14 |
| | | Mean | 33.15 |
| | | Std | 0.05 |
| | | % CV | 0.16 |
| | | % Diff | 0.30 |
| PT | MDA Verify 2 | 1 | 16.39 |
| | | 2 | 16.52 |
| | | 3 | 16.5 |
| | | 4 | 16.59 |
| | | Mean | 16.50 |
| | | Std | 0.07 |
| | | % CV | 0.43 |
| APTT | MDA Verify 2 | 1 | 57.25 |
| | | 2 | 58.25 |
| | | 3 | 58.57 |
| | | 4 | 58.56 |
| | | Mean | 58.16 |
| | | Std | 0.54 |
| | | % CV | 0.93 |
| | | % Diff | 2.07 |
| PT | MDA Verify 3 | 1 | 22.22 |
| | | 2 | 22.47 |
| | | 3 | 22.14 |
| | | 4 | 22.14 |
| | | Mean | 22.24 |
| | | Std | 0.14 |
| | | % CV | 0.61 |
| APTT | MDA Verify 3 | 1 | 77.33 |
| | | 2 | 78.35 |
| | | 3 | 78.01 |
| | | 4 | 78.33 |
| | | Mean | 78.01 |
| | | Std | 0.41 |
| | | % CV | 0.53 |
| | | % Diff | 1.15 |

As shown in Table 2 above, no significant carryover of thromboplastin is seen. The wash solution removed detectable amounts of the thromboplastin from the probe, without itself affecting any assay results.

We claim:

1. An aqueous cleaning solution comprising:

a. bile salt;

b. anionic surfactant;

c. organic acid;

d. sodium ions; and e. water, wherein said solution removes substantially all of a reagent selected from the group consisting of thrombin, thromboplastin, and phospholipids from a surface.

2. A solution according to claim 1, wherein said bile salt is taurocholic acid in a concentration range from about 0.1% to about 2.0%.

3. A solution according to claim 2, wherein the concentration range is from about 0.5% to about 1%.

4. A solution according to claim 2, wherein said anionic surfactant is present in a concentration range from about 0.2% to about 2.0%.

5. A solution according to claim 4, wherein the concentration range is from about 1.0% to about 1.5%.

6. A solution according to claim 4, wherein said organic acid is formic acid in a concentration range from about 0.2% to about 5.0%.

7. A solution according to claim 6, wherein said concentration range is from about 0.2% to about 2.0%.

8. A solution according to claim 6, wherein said sodium ions are provided by sodium chloride in a concentration range from about 0.5% to about 5.0%.

9. A solution according to claim 8, wherein said concentration range is from about 2.0% to about 3.0%.

10. A solution according to claim 1, wherein said solution removes all of said reagent from the surface of a probe or pipette within the probe cleaning or washing time allowed on an automated coagulation analyzer.

11. An aqueous cleaning solution comprising:

a. taurocholic acid in a concentration range from about 0.2% to about 1.0%;

b. a phosphorylated ethoxylated anionic surfactant in a concentration range from about 0.2% to about 2.0%;

c. formic acid in a concentration range from about 0.2% to about 5.0%;

d. sodium chloride in a concentration range from about 0.5% to bout 5.0%;

e. water to q.s. to 100%, wherein said solution substantially removes all of a reagent selected from the group consisting of thrombin, thromboplastin, and phospholipids from a surface.

12. A solution according to claim 11, wherein said solution removes substantially all of said reagent from the surface of a probe or pipette within the probe cleaning or washing time allowed on an automated coagulation analyzer.

* * * * *